US005203461A

United States Patent [19]

Hanson et al.

[11] Patent Number: 5,203,461

[45] Date of Patent: Apr. 20, 1993

[54] MINERAL JIG APPARATUS

[75] Inventors: Raymond A. Hanson; Wayne F. Crockett, both of Spokane, Wash.

[73] Assignee: R. A. Hanson Company, Inc., Spokane, Wash.

[21] Appl. No.: 771,621

[22] Filed: Oct. 4, 1991

[51] Int. Cl.[5] ..... B03B 5/56

[52] U.S. Cl. ..... 209/455; 209/456; 209/457

[58] Field of Search ..... 209/18, 455, 456, 457, 209/503, 504

[56] References Cited

U.S. PATENT DOCUMENTS

| | | | |
|---|---|---|---|
| 714,152 | 11/1902 | Cooley | 209/456 |
| 963,519 | 7/1910 | Cory | 209/457 |
| 1,378,521 | 5/1921 | Collins et al. | 209/455 |
| 1,391,531 | 9/1921 | Dorton | 209/456 |
| 1,400,910 | 12/1921 | Ransom, Jr. | 209/456 |
| 2,070,069 | 2/1937 | Ruoss | 209/455 |
| 2,793,750 | 5/1957 | Peterson | 209/457 |
| 2,963,155 | 12/1960 | Peterson et al. | 209/457 |
| 4,849,097 | 7/1989 | Hanson et al. | 209/425 |

FOREIGN PATENT DOCUMENTS

| | | | |
|---|---|---|---|
| 0299583 | 8/1917 | Fed. Rep. of Germany | 209/457 |
| 0855180 | 5/1940 | France | 209/457 |
| 1129004 | 1/1957 | France | 209/455 |

*Primary Examiner*—Robert P. Olszewski
*Assistant Examiner*—James R. Bidwell
*Attorney, Agent, or Firm*—Wells, St. John, Roberts, Gregory & Matkin

[57] ABSTRACT

A preferred mineral jig apparatus includes a jig tank having a laterally oriented piston and cylinder assembly mounted therewithin. The piston and cylinder assembly defines two compartments, with reciprocating motion of the piston causing pulsating action of the water within the two respective compartments. The piston and cylinder assembly includes a cylinder, a piston assembly and a piston rod connected to the piston assembly. The piston rod includes an internal channel to convey make-up water to the tank from an external water source. The piston rod is supported for lateral reciprocating motion by at least two downwardly hanging leaf springs. The piston assembly comprises a pair of separated piston plates oriented transversely relative to the cylinder. The separated piston plates defining a space therebetween as well as a separation distance between the piston plates. The piston rod is connected to one of the piston plates. The internal piston rod channel communicates with the space between the piston plates to expel make-up water thereto. The cylinder has a length which is approximately equal to the separation distance between the piston plates. One of the piston plates is moved into the cylinder upon a given piston stroke, while the other of the piston plates is moved away from the cylinder upon the given piston stroke. The mineral jig apparatus further comprises a drive mechanism for imparting reciprocating action to the piston.

20 Claims, 12 Drawing Sheets 42
50
66
20
24
10
14
12
40
62
48
52
54
74
82
72
74
58
58
46
70
44
36
30
38
12
22

42
50
68
20
24
60
62
28
30
12
26
80
32
84
40
64
48
78
84
60
62
71
46
82
76
34
44
58
72
56
52
54
70
74
58
24
36
38
84
84
10
12
14
22

MINERAL JIG APPARATUS

TECHNICAL FIELD

This invention relates to jigs.

BACKGROUND OF THE INVENTION

Jigging is one of the oldest methods for concentrating ores and is still widely used. It is a gravimetric method of concentration which utilizes differences in the densities of wanted and unwanted materials to effect their separation. In jigging, water is strongly pulsed upward and downward through a suspended bed of particles. After sufficient pulsation, the top portion of the bed becomes an accumulation of lighter gangue, which can be rejected, while the lower portion contains the heavier enriched concentrate.

Typical jigs use a jig tank which is open at its top and bottom ends. The top of the jig tank includes a perforated, tapered, and inclined chute through which the material being separated flows to the tank. Oversized material is prevented from entering the jig tank by perforated screens, and caused to flow down the tapered portion of the chute to be discharged from the jig. The screen typically has a removable grate on top of it which acts as a containment grid for ragging material, which is usually spherically-shaped material that is heavier than the ore being processed and sized larger than the screen mesh. The ragging acts like a check valve when the jig is operating. Water pulsations within the jig lift the ragging up and off the screen and create a dilation of the bed of material above the screen. This puts particles in the bed in a state of suspension. Heavier particles within the bed progress downwardly into the ragging until they are finally able to pass through the screen. The particles settle within the tank until they are able to exit at the bottom through a valve.

The lower portion of the jig tank is angled inwardly to cause the heavier, concentrated material to flow to an outlet through which water and material having been concentrated flows. The jig tank is also provided with a source of make-up water, commonly referred to as hutch water, to replace water removed through the exit portion of the jig tank, and to fill the volume of water that is displaced by the piston on the power stroke.

One method of imparting the pulsating or oscillating motion of water within the jig tank is illustrated in our U.S. Pat. No. 4,849,097. There illustrated is a trapezoidal shaped jig tank the lower portion of which is angled inwardly to join with a vertically movable cone by means of a fluid-tight flexible diaphragm. The movable cone is mounted to a pivotal frame arm, commonly referred to as a walking beam, which is pivotally driven to generate pulsations within the tank.

This invention relates to alternate mechanisms and means for imparting oscillating or pulsation motion of water within a jig tank.

This invention relates to alternate mechanisms and means for imparting oscillating or pulsation motion of water within a jig tank.

BRIEF DESCRIPTION OF THE DRAWINGS

Preferred embodiments of the invention are described below with reference to the accompanying drawings.

FIG. 4 is a partial sectional view corresponding in position to the section view of FIG. 3 and showing the jig apparatus in one operational position.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

In accordance with one aspect of the invention, a mineral jig apparatus comprises:

a supporting framework;

at least one jig tank which retains water and material being concentrated, the jig tank having a lower portion and an upper portion, the upper portion having a screen atop which ore to be processed is fed to the jig, the lower portion having a drain for discharging concentrated ore from the tank, the jig tank being substantially separated into at least two compartment;

a piston and cylinder assembly mounted within the tank, the piston and cylinder assembly defining an interface between the two compartments to reciprocating pulsate water within the two respective compartments upon reciprocating motion of a piston within a cylinder; and drive means for imparting reciprocating action to the piston.

In accordance with another aspect of the invention a mineral jig apparatus comprises;

a supporting framework;

at least one jig tank which retains water and material being concentrated, the jig tank having a lower portion and an upper portion, the upper portion having a screen atop which ore to be processed is fed to the jig, the lower portion having a drain for discharging concentrated ore from the tank, the jig tank being substantially separated into at least two compartments which are laterally oriented relative to one another;

an agitator mounted within the tank to impart pulsations to water within the two respective compartments, the agitator including a driving rod, the driving rod being supported for reciprocating motion by at least two leaf springs; and drive means for imparting reciprocating motion to the driving rod.

Figure 1:
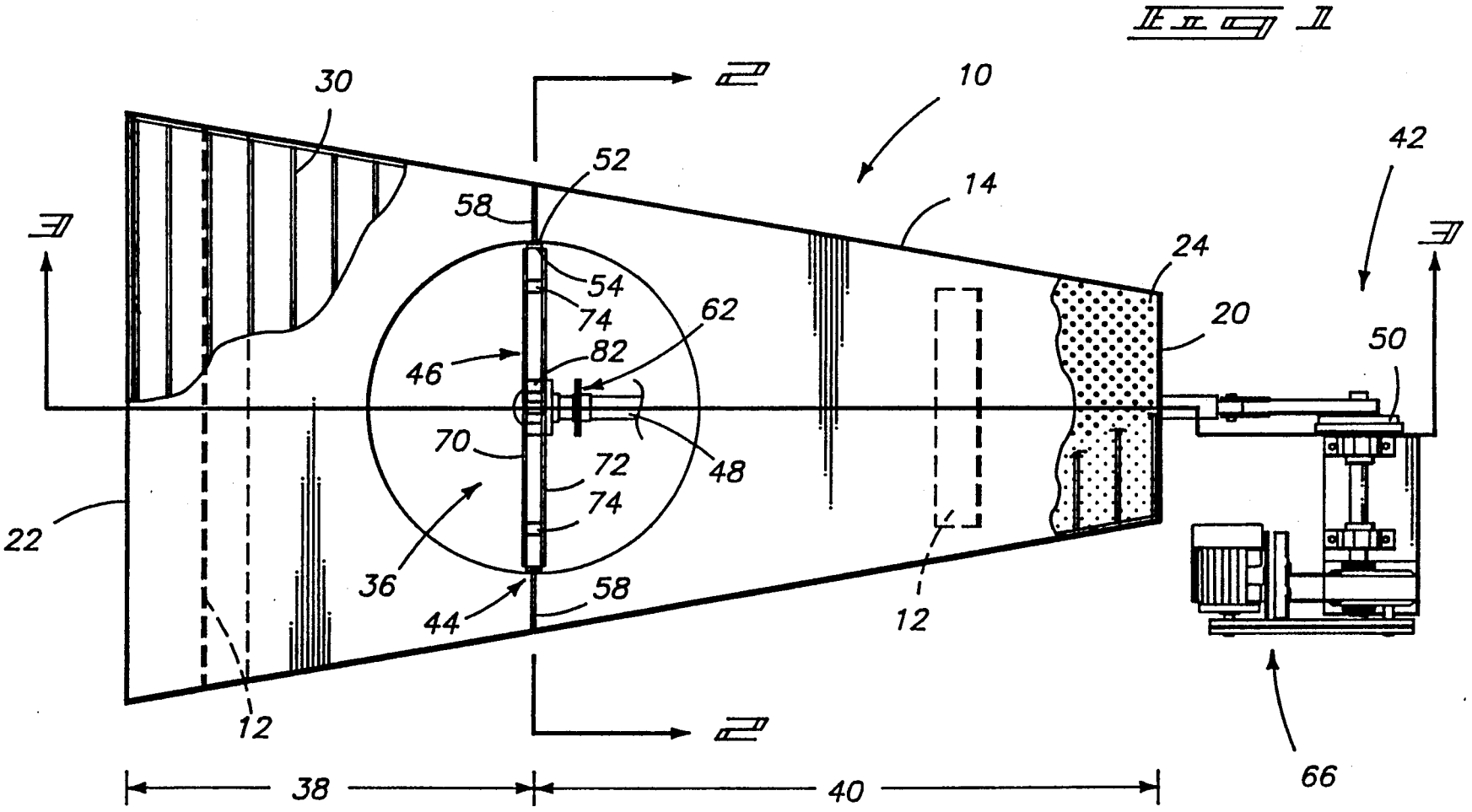
FIG. 1 is a top plan view of a mineral jig apparatus in accordance with the invention.
Figure 2:
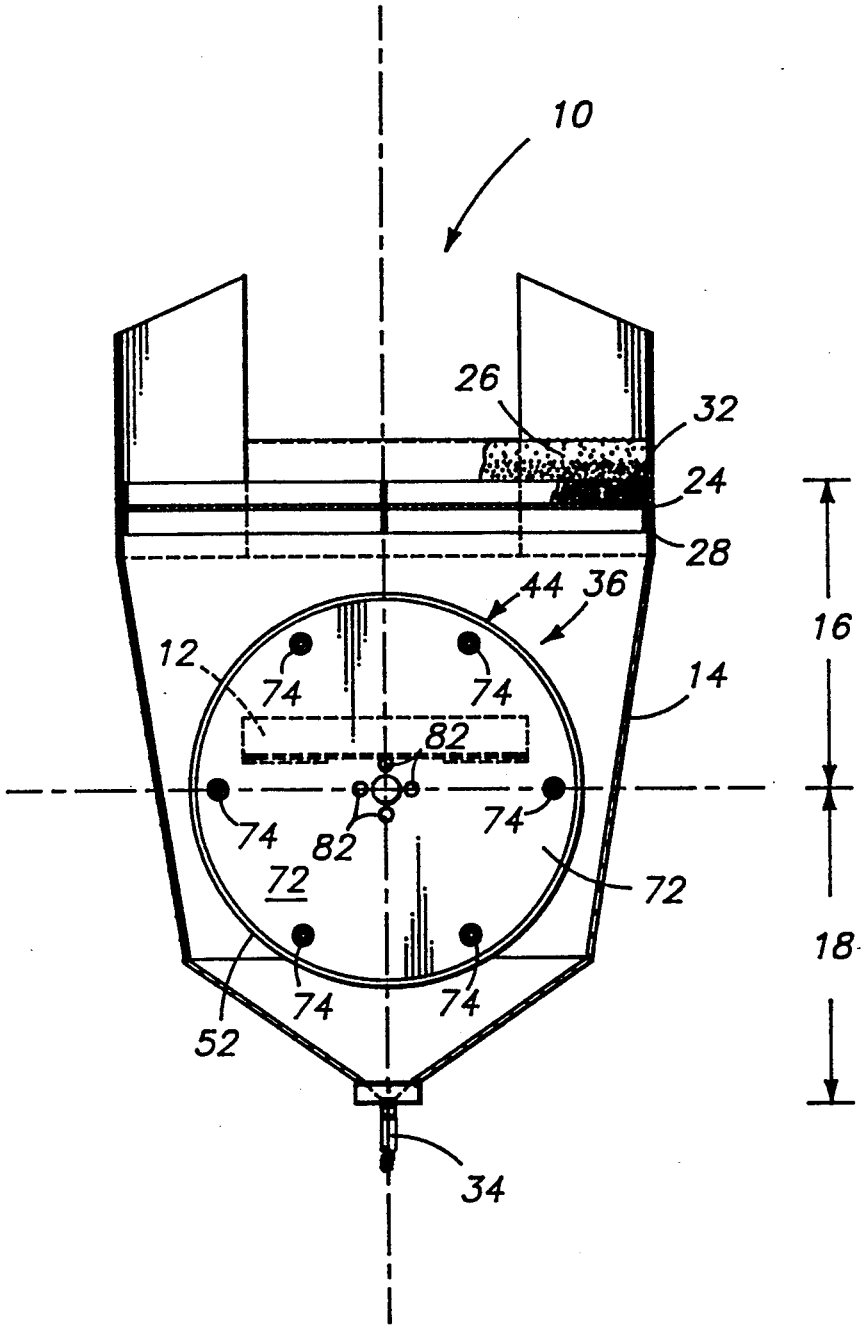
FIG. 2 is a sectional view taken through line 2—2 in FIG. 1.
Figure 3:
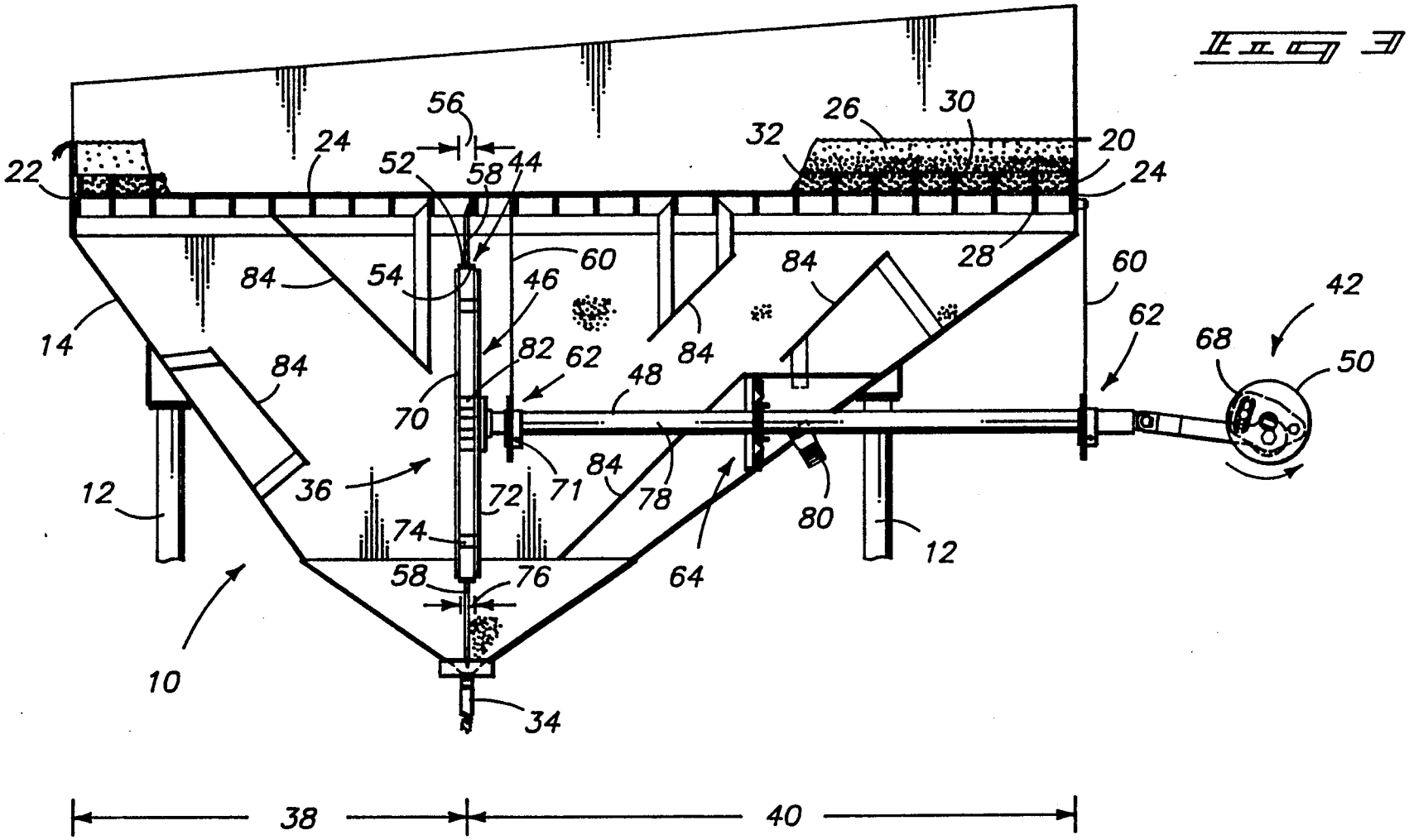
FIG. 3 is a sectional view taken through line 3—3 of FIG. 1.

Referring first to FIGS. 1-3, a preferred embodiment jig in accordance with the invention is indicated generally by reference numeral 10. Jig 10 includes a base or supporting framework 12 which supports the various jig components. Framework 12 supports a jig tank 14 which retains water and the ore being concentrated. Jig tank 14 includes an upper portion 16 and a lower portion 18 (FIG. 2). Tank 14 is open and trapezoidal in cross sectional shape, tapering outwardly from an intake end 20 to a discharge end 22. Upper tank portion 16 includes a screen 24 atop which ore 26 to be processed is fed to jig 10. Screen 24 is supported by a grate 28. Screen 24 itself supports a removable grate 30 thereatop which acts as a containment grid for ragging material 32. Ragging 32 is typically spherically-shape material which is heavier than the ore being processed, and larger than the screen mesh to act like the conventional check valve when jig 10 is operating.

Lower tank portion 18 is provided with a drain 34 for discharging concentrated ore from tank 14. An agitator assembly 36 is mounted in tank 14 to impart pulsations to water therewithin to provide the desired jiggling action.

More particularly, agitator assembly 36 comprises a piston and cylinder assembly which substantially separates jig tank 14 into two compartments 38, 40 (FIGS. 1 and 3). Compartments 38 and 40 are laterally oriented relative to one another. Drain 34 comprises a single drain which communicates with each compartment 38 and 40. Compartments 38 and 40 are in direct fluid communication with one another immediately adjacent single drain 34, as is more fully described below. Piston and cylinder assembly 36 is mounted within tank 14 to provide reciprocating motion of a piston in a lateral direction to reciprocating pulsate water within compartments 38 and 40. Reciprocating motion is imparted by a drive mechanism 42.

Piston and cylinder assembly 36 comprises a cylinder 44, a piston assembly 46, and a piston or driving rod 48 connected to piston assembly 46. Piston rod 48 in turn connects to drive assembly 42 by means of an adjustable eccentric crank 50. Piston assembly 46 and cylinder 44 are circular in lateral cross section. Cylinder 44 comprises a ring-like member 52 which defines cylinder sidewalls 54 having a defined length 56 (FIG. 3). Ring member 52 is supported relative to tank 14 by means of supporting bracket flanges 58. The lower portion of bracket flanges 58 is mounted as shown elevationally above drain 34 such that compartments 38 and 40 are in direct fluid communication with one another immediately adjacent single drain 34.

Figure 6:
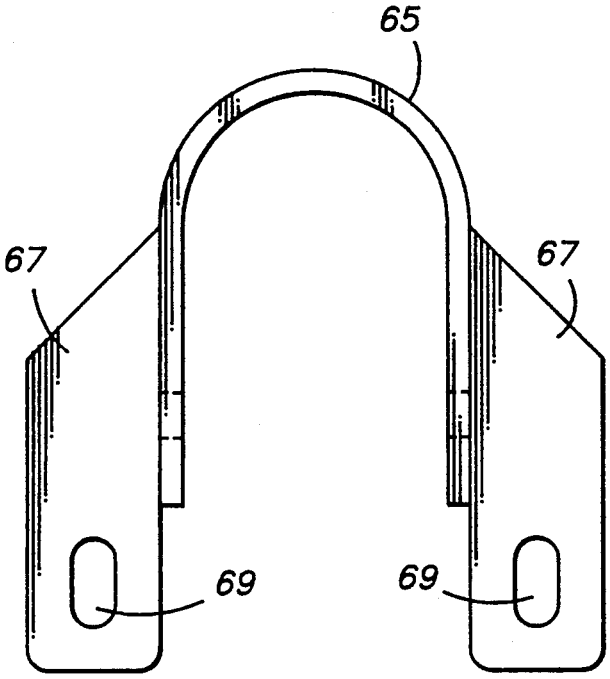
FIG. 6 is a front elevational view of a mounting assembly shown in FIGS. 1 and 3.
Figure 7:
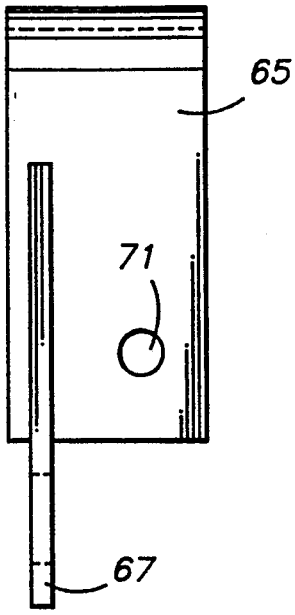
FIG. 7 is a side elevational view of the mounting assembly of FIG. 6.
Figure 8:
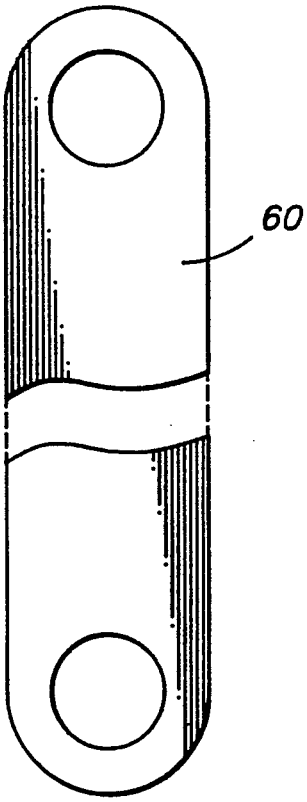
FIG. 8 is facing elevational view of a spring apparatus shown in FIGS. 1 and 3.
Figure 9:
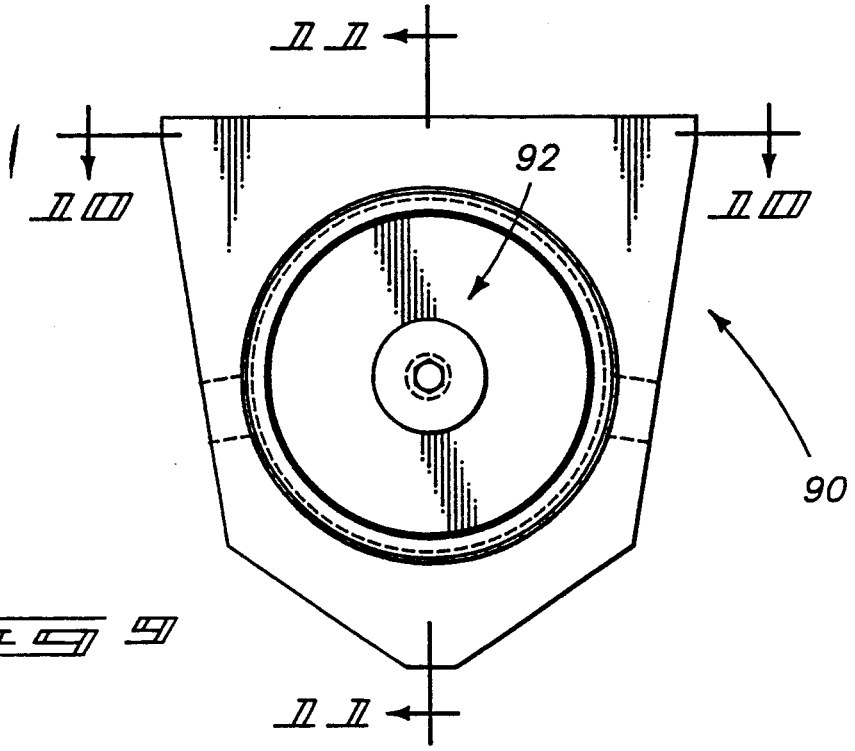
FIG. 9 is a cross sectional view of a first alternate embodiment mineral jig apparatus in accordance with the invention, and corresponds in position to the section of FIG. 2 of the first described embodiment.
Figure 10:
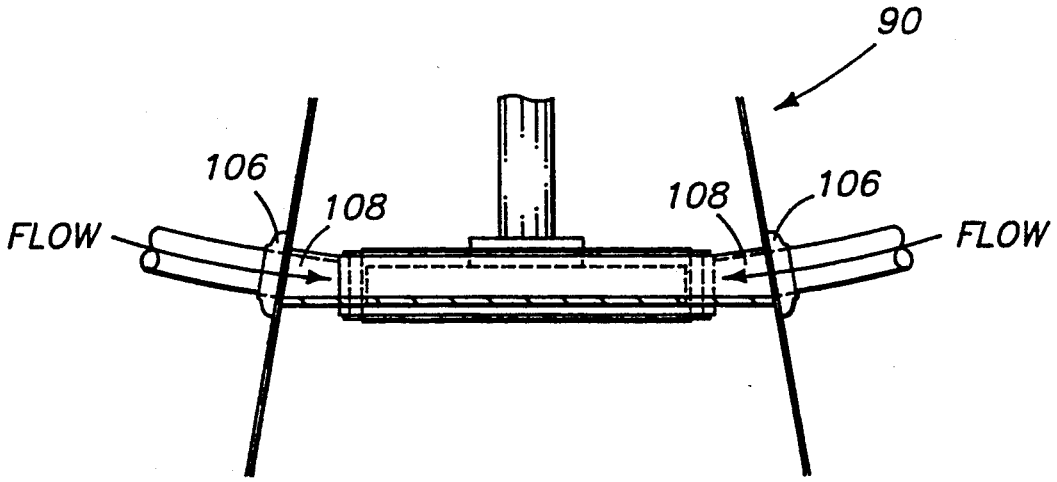
FIG. 10 is a partial sectional view taken through line 10—10 in FIG. 9.
Figure 11:
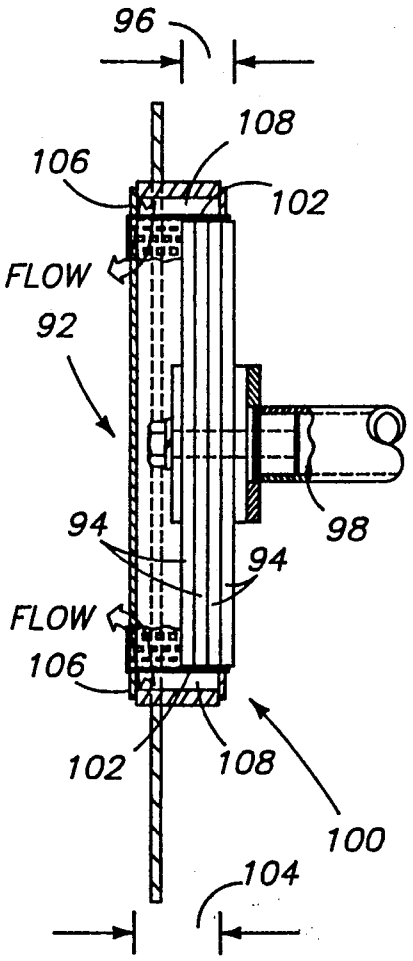
Figure 12:
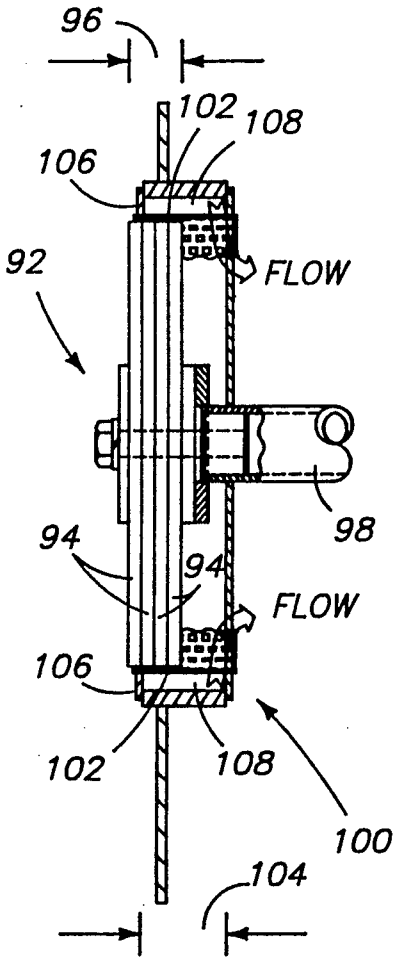
FIG. 12 is a partial cross sectional view corresponding in position to that of FIG. 11 showing the first alternate embodiment mineral jig apparatus in one operational position.
Figure 13:
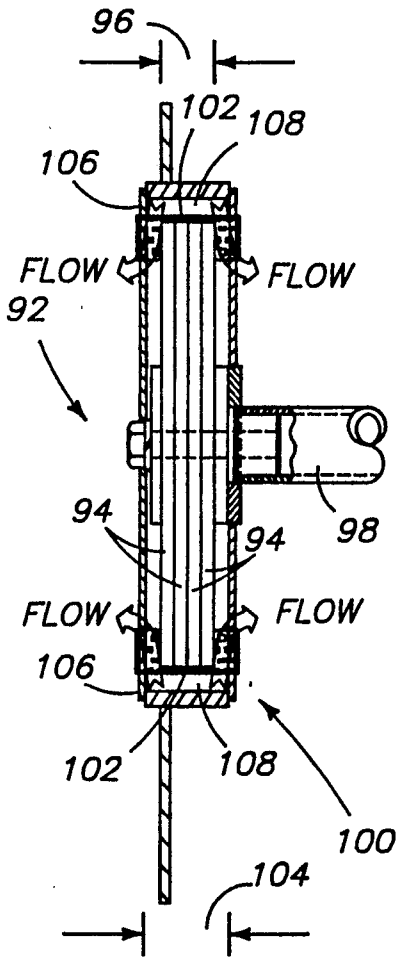
FIG. 13 is a partial cross sectional view corresponding in position to that of FIG. 11 showing the first alternate embodiment mineral jig apparatus in another operational position.
Figure 14:
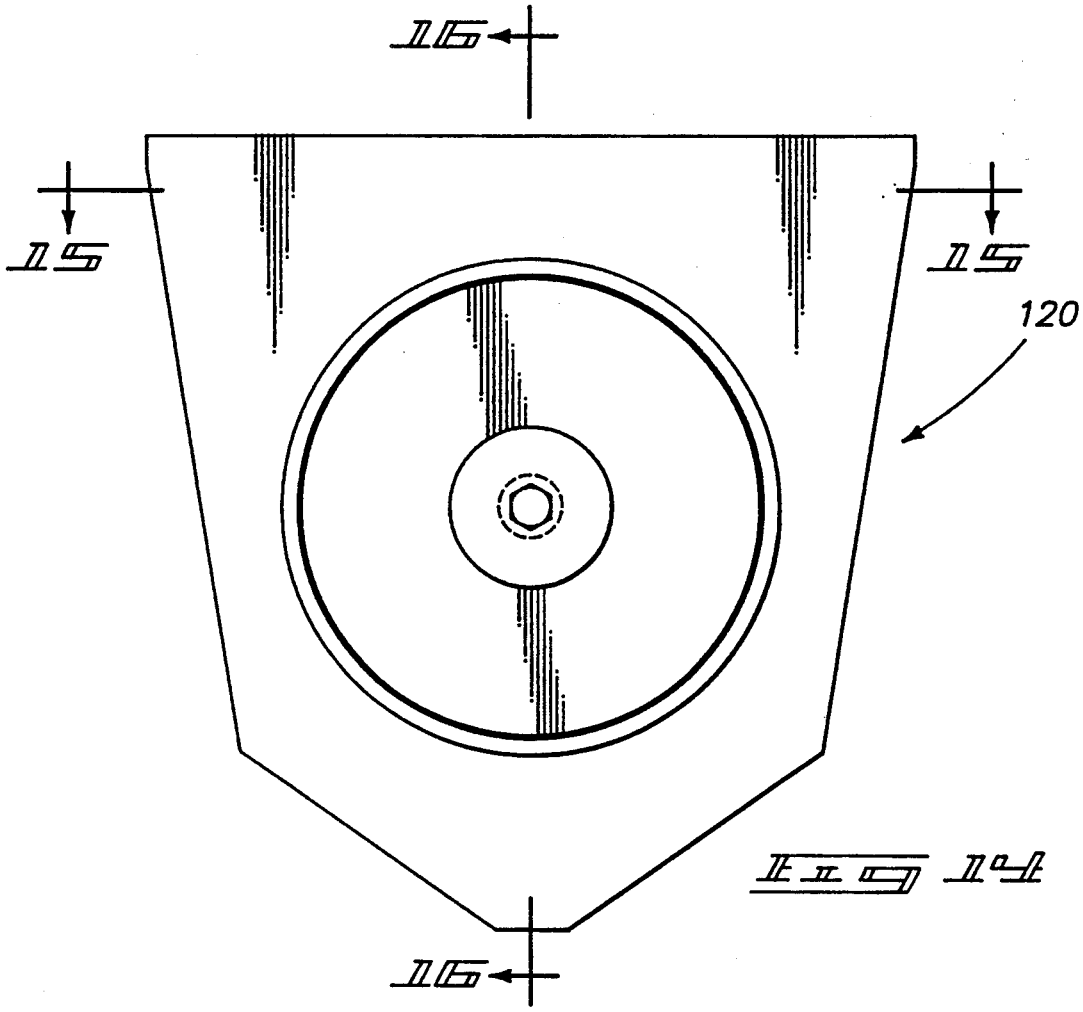
FIG.14 is a cross sectional view of a second alternate embodiment mineral jig apparatus corresponding in position to the section of FIG. 2 of the first described embodiment.
Figure 15:
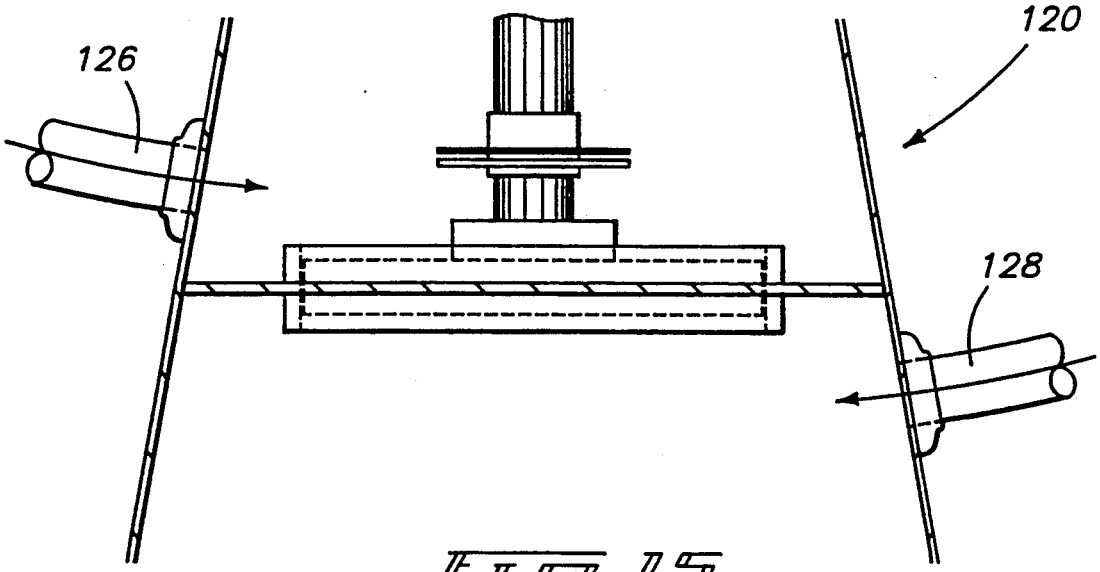
FIG. 15 is a partial sectional view taken through line 15—15 in FIG. 14.
Figure 18:
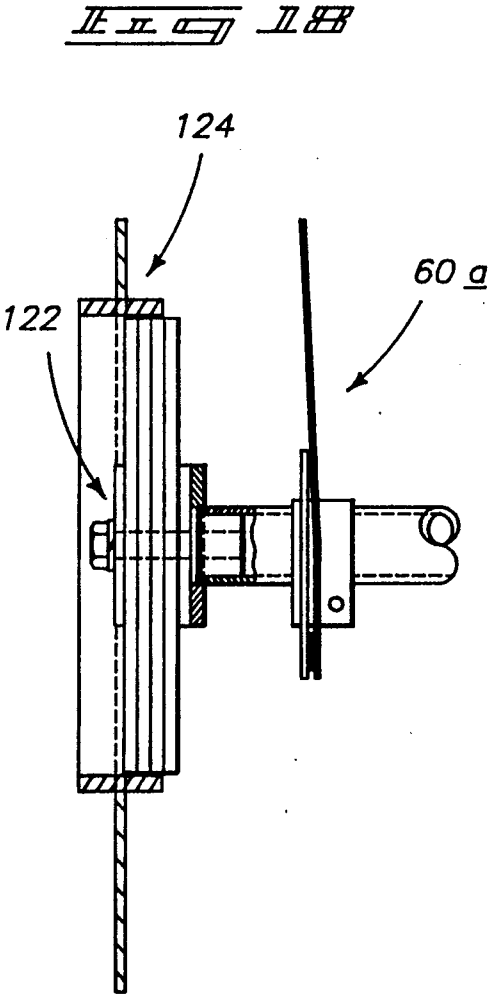
FIG. 18 is a partial cross sectional view corresponding in position to that of FIG. 16 showing the second alternate embodiment mineral jig apparatus in another operational position.
Figure 17:
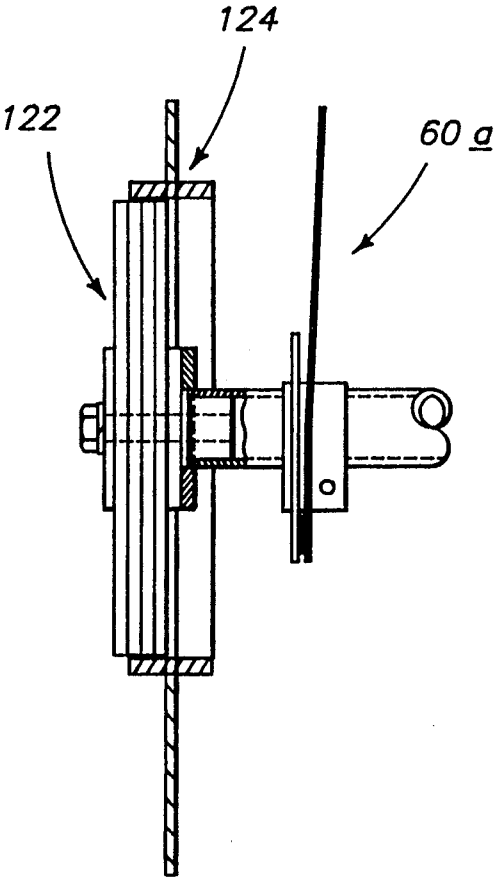
FIG. 17 is a partial cross sectional view corresponding in position to that of FIG. 16 showing the second alternate embodiment mineral jig apparatus in one operational position.
Figure 16:
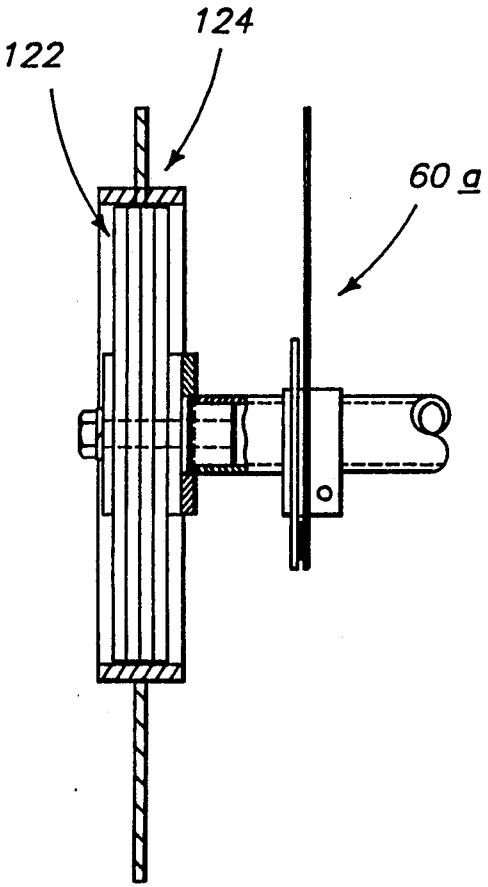
FIG. 16 is a partial sectional view taken through line 16—16 of FIG. 14.
Figure 19:
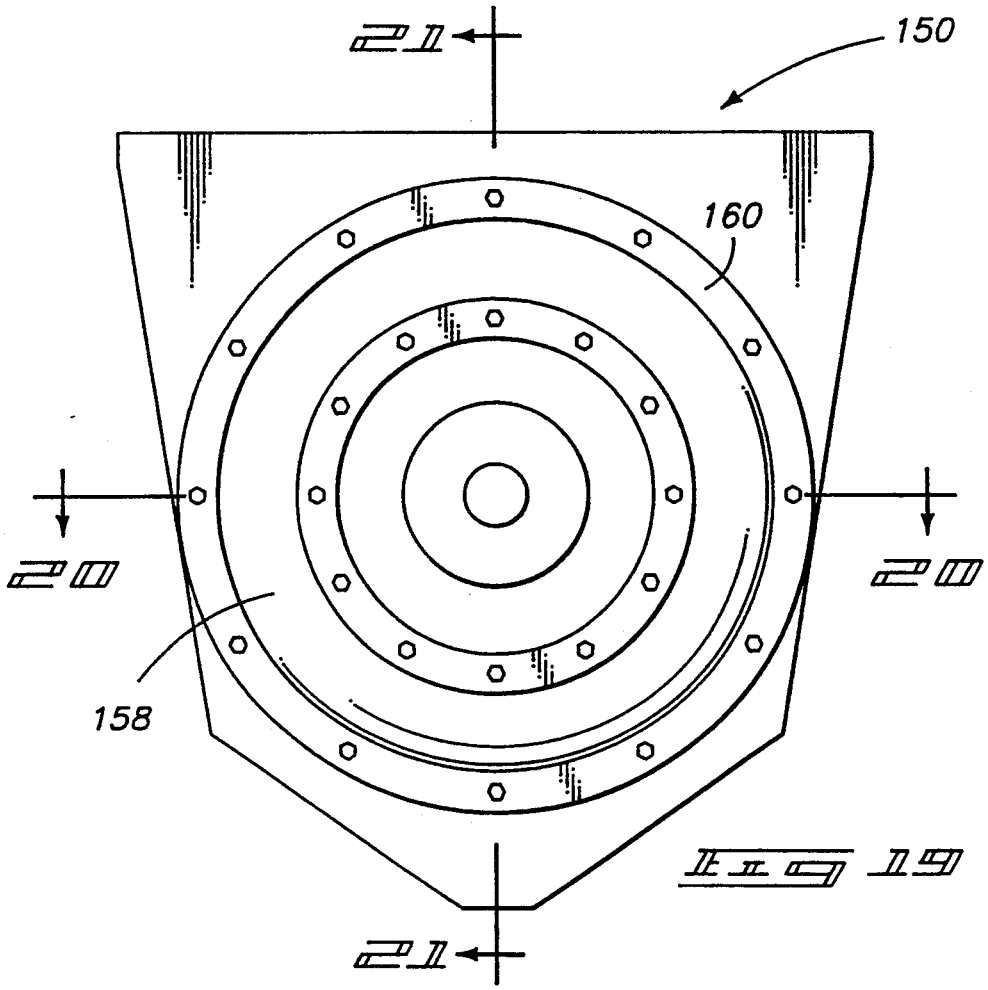
FIG. 19 is a cross sectional view of a third alternate embodiment mineral jig apparatus in accordance with the invention corresponding in position to the section of FIG. 2 of the first described embodiment.
Figure 20:
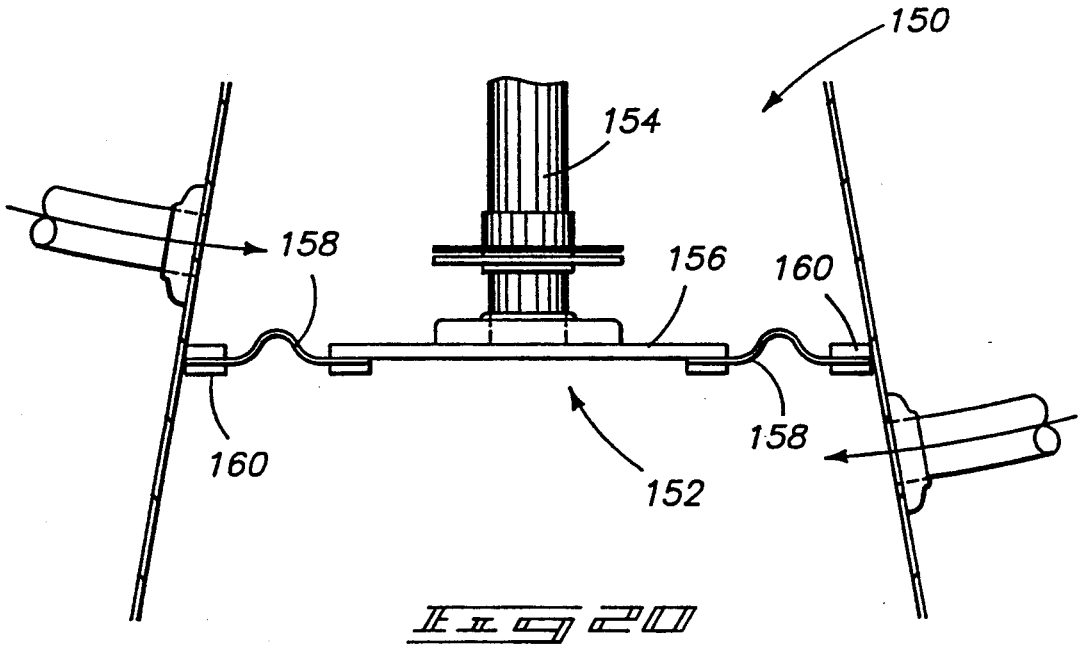
FIG. 20 is a partial sectional view taken through line 20—20 of FIG. 19.

Piston rod 48 is supported for lateral reciprocating motion within cylinder 44 by four leaf springs 60 (FIGS. 3 and 8) which are positioned in pairs at the generally opposite ends of piston rod 48. Springs 60 hang downwardly relative to the jig screen and grate as shown. Such leaf springs are preferably comprised of a high carbon steel, such as SAE 1095 or ASTM A-682. Leaf springs 60 provide elevational support for piston rod 48, and as well provide generally limited lateral movement to enable the desired reciprocating motion. Leaf springs 60 are mounted relative to piston rods 48 by means of mounting assemblies 62 (FIGS. 3, 6 and 7). Such assemblies include a "U" bracket 65 having a pair of projecting wings 67. Each wing 67 includes an elongated slot 69 which aligns with holes in springs 60, and are secured relative to each other by a nut and bolt assembly (not shown). Bracket 65 is provided with a pair of aligned holes 71 through which nut and bolt assembly (not shown) is provided for securing bracket 65 to piston rod 48. Springs 60 secure relative to a suitable portion of tank 14 by nuts and bolts (not shown).

Figure 5:
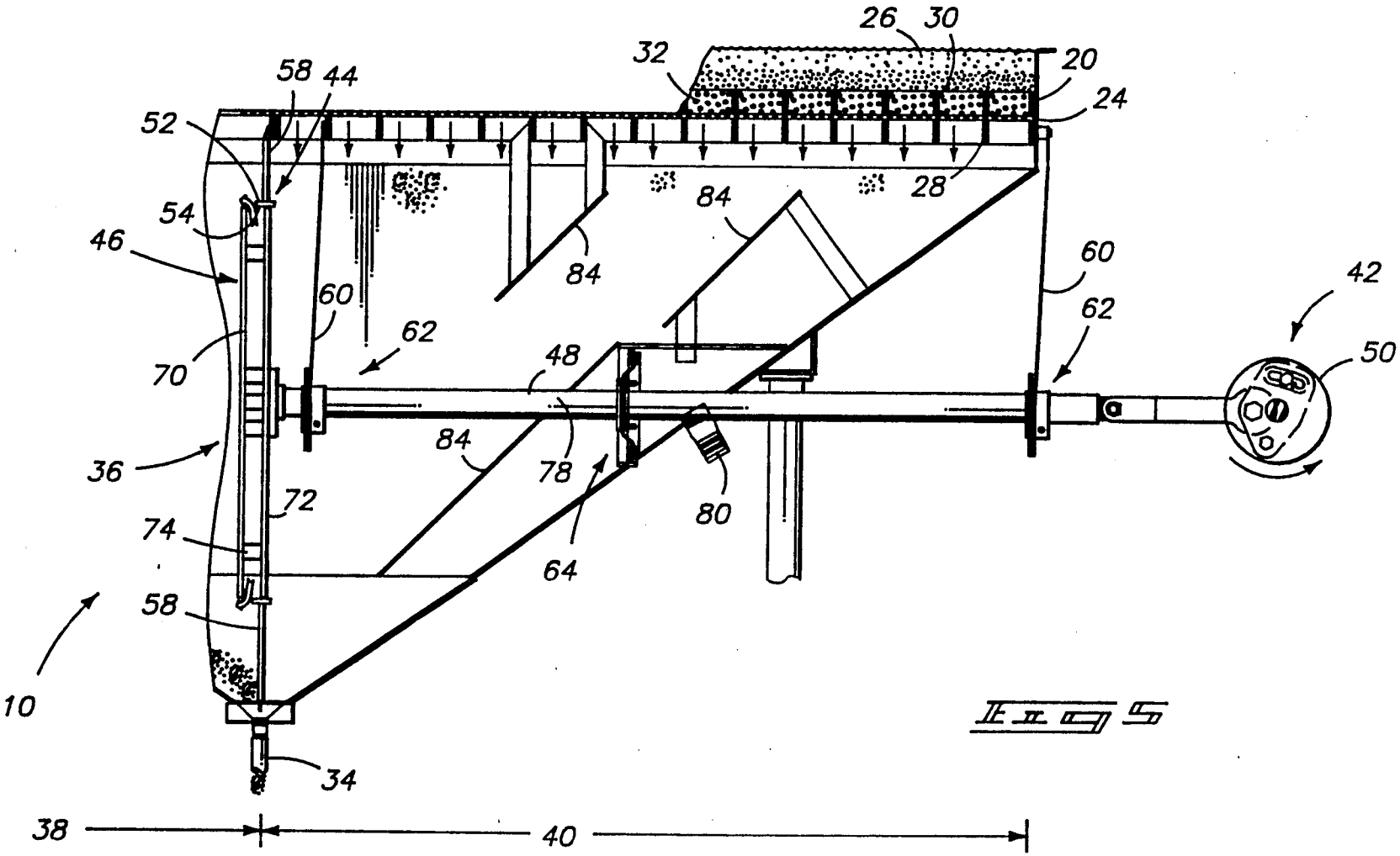
FIG. 5 is a partial sectional view corresponding in position to the section view of FIG. 3 showing the jig apparatus in another operational position.

The left portion of piston rod 48, as shown in FIG. 3, is received within compartment 40 of tank 14, while the right portion of piston rod 48 is external to tank 14. To enable reciprocating movement of piston rod 48 relative to tank 14, and to provide a fluid tight seal between tank 14 and portions external to tank 14, a flexible diagram assembly 64 is provided. Such enables limited reciprocating motion of piston rod 48 upon driving action by drive mechanism 42, as is best illustrated by FIGS. 4 and 5. The right end of piston rod 48 (FIGS. 1 and 3) connects with drive unit 42.

Drive unit 42 includes adjustable eccentric crank 50 which is driven by a drive unit 66. Eccentric crank 50 is of a conventional construction the eccentricity of which is adjustable to enable selective variation of the piston stroke by means of a slot and bolt/nut assembly 68.

Piston assembly 46 is comprised of a pair of separated piston plates 70, 72 which are oriented transversely relative to cylinder 44. Piston plates 70 and 72 preferably comprise two one-half inch thick steel plates. Plates 70 and 72 are mounted relative to one another by a series of spacers 74 which can be suitably welded relative to plate 70 or 72, or secured by other conventional means such as with nuts and bolts. Spacers 74 define a separation distance 76 between plates 70 and 72 which is approximately equal to cylinder length 56 (FIG. 3). Piston rod 48 connects relative to piston plate 72 and communicates therethrough as is more fully described below.

Piston rod 48 is in the form of a pipe (preferably two and seven eighths inch OD) which provides an internal channel 78 for conveying make-up or hutch water to tank 14 from an external water source. Means for connecting internal channel 78 with an external water source is provided in the form of a threaded male connector 80. Internal piston rod channel 78 communicates through piston plate 72 to the space between piston plates 70 and 72. Additional spacers/diffusers 82 are centrally provided to provide uniform radial flow of water outwardly from the central portion of the space between plates 70 and 72. Jig tank 14 is as well provided with a series of baffles 84 for uniformly translating lateral reciprocating pulsations of the water by movement of piston rod 48 into an upward direction relative to ore bed 26 and ragging 32.

Operation of the apparatus is best understood by reference to FIGS. 3-5. FIG. 3 depicts mineral jig apparatus 10 in a mid stroke condition, and the piston could be traversing either direction. Upon counter clockwise rotation of eccentric drive 50 (FIG. 4), piston rod 48 is drawn rearwardly (to the right as shown) pulling leaf springs 60 to the right. Diaphragm assembly 64 is as well flexed to the right. This action tends to pull piston plate 72 away from cylinder 44 while moving piston plate 70 into cylinder 44. Upon continued counter clockwise rotation of eccentric crank 50, the motion of piston rod 48 is reversed and moved through the position of FIG. 3 to a maximum forward stroke position as illustrated by FIG. 5. Here, leaf springs 60 have been caused to move fully to the left, as well as diaphragm assembly 64 flexed to the left. Such motion causes piston plate 72 to be moved into cylinder assembly 44 upon the piston stroke, while piston plate 70 is moved away or out from cylinder assembly 44.

Make-up hutch water is continuously provided through piston rod 48 at a rate sufficient to replace water removed via drain 34 and by the piston stroke on the negative side of the piston to reduce the suction force. The arrows emanating from between plates 70 and 72 in FIG. 4 depict hutch water flow being ejected into right compartment 40. Such arrows in FIG. 5 depict hutch water flow being ejected into left compartment 38.

Such an assembly imparts reciprocating lateral pulsations to water within tank 14. The lateral pulsations are effectively directed upwardly to ragging 24 and ore 26 by means of the variously positioned baffle plates 84. Such is indicated by the right-angle flow arrows (FIG. 4) at the faces of baffle plates 84.

Compartments 38 and 40 are in direct fluid communication with one another immediately adjacent drain 34 which facilitates draining of concentrated ore from each compartment. Further, such minimizes clogging and facilitates any necessary unclogging of ore relative to drain 34. Such results from the reciprocating action of the piston which provides water pulsations between the compartments 38 and 40 immediately adjacent drain 34. This tends to keep concentrated ore in a state of suspension adjacent drain 34, thus preventing clogging.

A first alternate embodiment mineral jig apparatus is indicated generally by reference numeral 90 and described with reference to FIGS. 9-13. Construction of such apparatus 90 is similar in many respects to apparatus 10 of FIGS. 1-8, such that only major differences will be described. Here, apparatus 90 is comprised of a piston assembly 92 comprised of a series of four tightly sandwiched piston plates 94. Such could be provided of any suitable material such as plastic or metal. Plates 94 provide an overall piston length 96 along the general lateral line of piston stroke. Piston assembly 92 is supported by a piston rod 98.

Piston assembly 92 is mounted within a cylinder assembly 100 having sidewalls 102 having a length 104 along the line of piston stroke which is greater than piston length 96. Sidewalls 102 are comprised of encircling screen material. An encircling plenum chamber 108 is outwardly provided relative to sidewalls 102. Diametrically opposed make-up water inlets 106 are provided to plenum chamber 108. Plenum chambers 108 have a length which is substantially equal to cylinder length 104 and greater than piston length 96. The length of plenum chambers 108 effectively lengthens the make-up water inlets to the jig to a distance greater than piston length 96.

Figure 11:
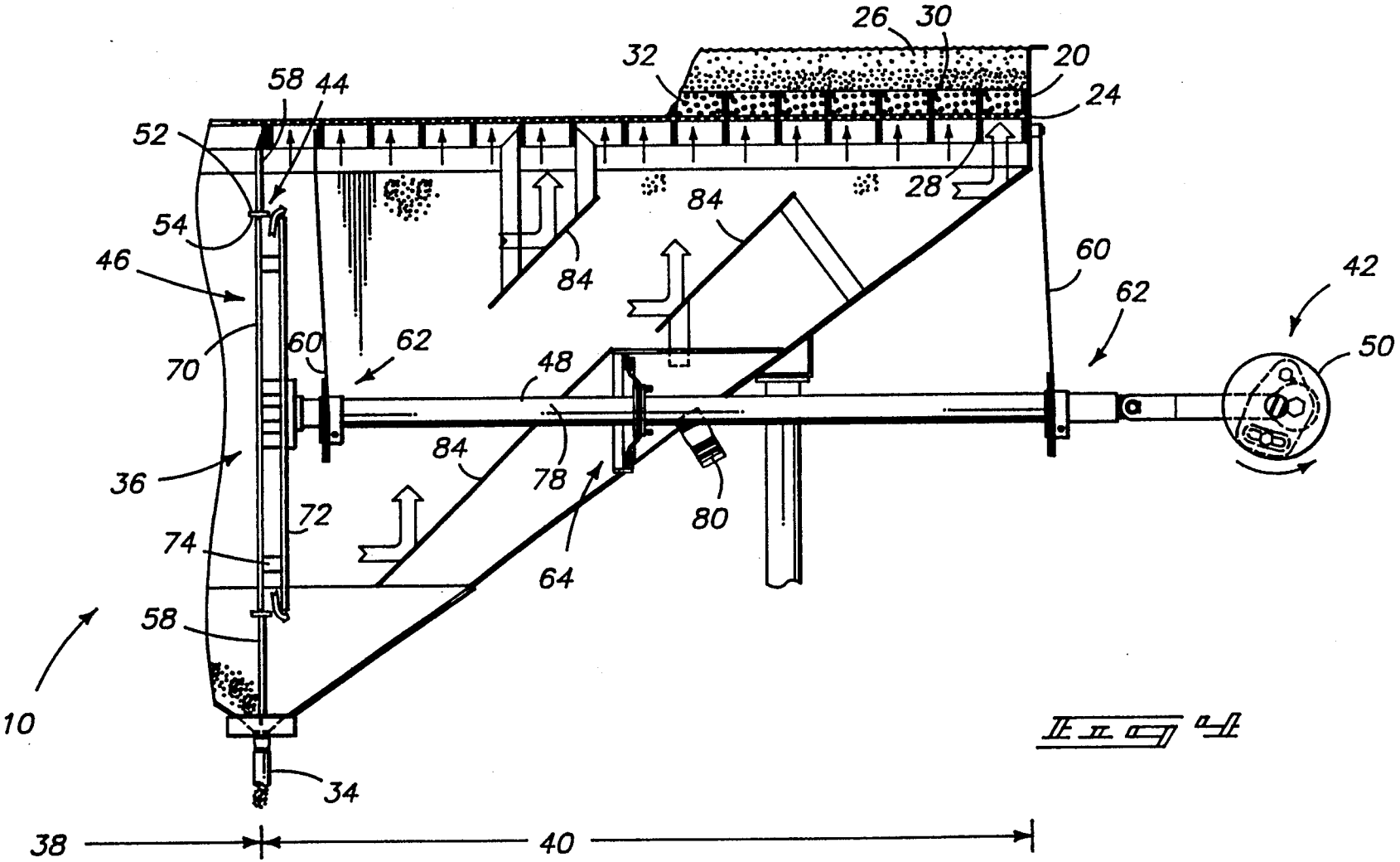
FIG. 11 is a partial sectional view taken through line 11—11 in FIG. 9.

Operation of apparatus 90 would be similar to that of FIGS. 1-8 but for the provision of make-up water to the jigging tank. As illustrated in FIG. 11, when piston assembly 92 were in the central position, water is caused to flow into both lateral tank chambers. On the other hand, when the stroke is fully towards the left, piston assembly 92 blocks the far left position of plenum chamber 108 causing water flow into the right lateral chamber. When piston assembly 92 is in the full right position, the right portion of plenum chamber 108 is blocked causing water to flow into the left chamber of the jig tank, thus enabling water levels within the respective compartments to remain substantially equal. Water pressure is preferably provided at 3 to 4 psig to suspend piston plates 94 between screen walls 102 during operation. Such obviates the need for leaf springs.

A second alternate embodiment mineral jig apparatus is indicated generally by reference numeral 120 and is described by reference to FIGS. 14-18. Here, the piston assembly 122 is substantially the same as the piston assembly 92 of the FIGS. 9-13 embodiment. Cylinder assembly 124 is substantially the same as the cylinder assembly 44 of the FIGS. 1-8 embodiment, having a slightly longer length along the line of piston stroke. Make-up water is provided by means of two inlets 126, 128 separately into the two lateral compartments and apart from the piston and cylinder assemblies. Spring assemblies 60*a* are provided for supporting the piston rod. Such construction is the same as in the FIGS. 1-8 embodiment.

Figure 23:
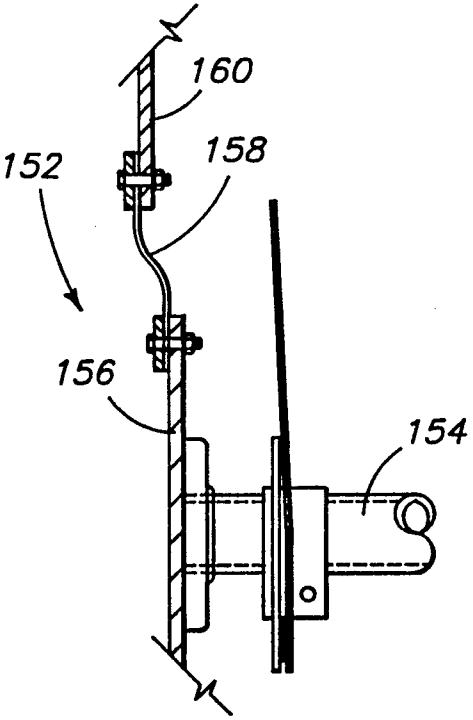
FIG. 23 is a partial cross sectional view corresponding in position to that of FIG. 21 showing the third alternate embodiment mineral jig apparatus in another operational position.
Figure 22:
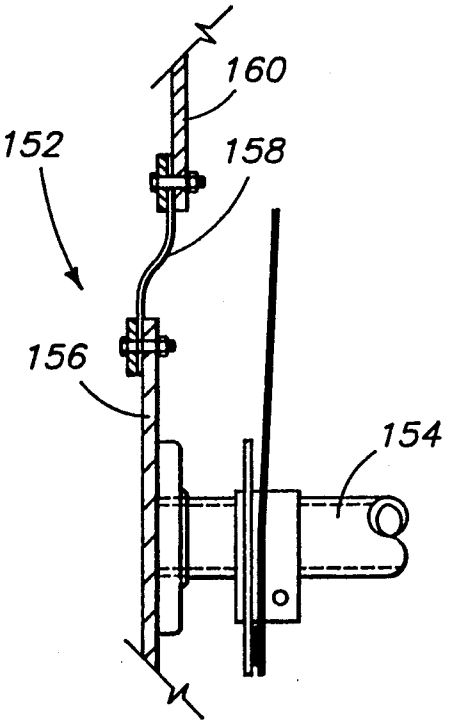
FIG. 22 is a partial cross sectional view corresponding in position to that of FIG. 21 showing the third alternate embodiment mineral jig apparatus in one operational position.
Figure 21:
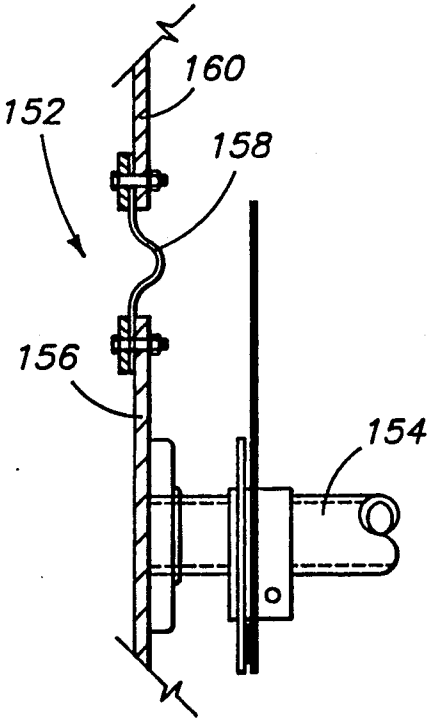
FIG. 21 is a partial sectional view taken through line 21—21 of FIG. 19.

A third alternate embodiment mineral jig apparatus is indicated generally by reference numeral 150 in FIGS. 19-23. Here, water is separately provided relative to the lateral tank compartments in the same manner as with the second alternate embodiment of FIGS. 14-18. However, the agitator construction of FIGS. 19-23 is different, being in the form of a plate and diaphragm assembly 152. Here, a driving rod 154 connects with a circular central plate 156. Plate 156 is externally mounted to an annular flexible diaphragm 158. Annular diaphragm 158 is in turn mounted to an external ring 160 which is welded or otherwise secured relative to the jig tank. Reciprocating motion of piston rod 154 imparts pulsating movement to plate 156 and movement of diaphragm 158 as best illustrated in FIGS. 21–23. Piston rod 154 is supported by means of the suspension springs of the FIGS. 1–8 embodiment.

The above described construction provides improved drive mechanisms over the drive mechanisms such as shown in our U.S. Pat. No. 4,849,097. Less costly and more easily managed driving components are thereby utilized.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A mineral jig apparatus comprising:

a supporting framework;

at least one jig tank which retains water and material being concentrated, the jig tank having a lower portion and an upper portion, the upper portion having a screen atop which ore to be processed is fed to the jig, the lower portion having a drain for discharging concentrated ore from the tank, the jig tank being substantially separated into at least two compartments;

a piston and cylinder assembly mounted within the tank, the piston and cylinder assembly defining an interface between the two compartments to reciprocatingly pulsate water within the two respective compartments upon reciprocating motion of a piston within a cylinder;

drive means for imparting reciprocating action to the piston; and the piston and cylinder assembly including a piston rod for driving the piston, the piston rod being supported for reciprocating motion by at least two leaf springs.

2. A mineral jig apparatus comprising:

a supporting framework;

at least one jig tank which retains water and material being concentrated, the jig tank having a lower portion and an upper portion, the upper portion having a screen atop which ore to be processed is fed to the jig, the lower portion having a drain for discharging concentrated ore from the tank, the jig tank being substantially separated into at least two compartments;

a piston and cylinder assembly mounted within the tank, the piston and cylinder assembly defining an interface between the two compartments to reciprocatingly pulsate water within the two respective compartments upon reciprocating motion of a piston within a cylinder;

drive means for imparting reciprocating action to the piston; and the piston and cylinder assembly including a piston rod for driving the piston, the piston rod including an internal channel to convey make-up water to the tank from an external water source, the piston rod including means for connecting the internal channel with an external water source.

3. A mineral jig apparatus comprising:

a supporting framework;

at least one jig tank which retains water and material being concentrated, the jig tank having a lower portion and an upper portion, the upper portion having a screen atop which ore to be processed is fed to the jig, the lower portion having a drain for discharging concentrated ore from the tank, the jig tank being substantially separated into at least two compartments;

a piston and cylinder assembly mounted within the tank, the piston and cylinder assembly defining an interface between the two compartments to reciprocatingly pulsate water within the two respective compartments upon reciprocating motion of a piston within a cylinder;

drive means for imparting reciprocating action to the piston;

the piston and cylinder assembly being mounted within the tank such that the reciprocating motion of the piston is in a lateral direction; and the piston and cylinder assembly including a piston rod for driving the piston, the piston rod being supported for reciprocating motion by at least two downwardly hanging leaf springs.

4. A mineral jig apparatus comprising:

a supporting framework;

at least one jig tank which retains water and material being concentrated, the jig tank having a lower portion and an upper portion, the upper portion having a screen atop which ore to be processed is fed to the jig, the lower portion having a drain for discharging concentrated ore from the tank, the jig tank being substantially separated into at least two compartments;

a piston and cylinder assembly mounted within the tank, the piston and cylinder assembly defining an interface between the two compartments to reciprocatingly pulsate water within the two respective compartments upon reciprocating motion of a piston within a cylinder;

drive means for imparting reciprocating action to the piston; and the piston and cylinder assembly including a piston rod for driving the piston, the piston rod being supported for reciprocating motion by at least two leaf springs, the piston rod including an internal channel to convey make-up water to the tank from an external water source, the piston rod including means for connecting the internal channel with an external water source.

5. A mineral jig apparatus comprising:

a supporting framework;

at least one jig tank which retains water and material being concentrated, the jig tank having a lower portion and an upper portion, the upper portion having a screen atop which ore to be processed is fed to the jig, the lower portion having a drain for discharging concentrated ore from the tank, the jig tank being substantially separated into at least two compartments;

a piston and cylinder assembly mounted within the tank, the piston and cylinder assembly defining an interface between the two compartments to reciprocatingly pulsate water within the two respective compartments upon reciprocating motion of a piston within a cylinder;

drive means for imparting reciprocating action to the piston;

the piston and cylinder assembly being mounted within the tank such that the reciprocating motion of the piston is in a lateral direction; and the piston and cylinder assembly including a piston rod for driving the piston, the piston rod being supported for reciprocating motion by at least two leaf springs, the piston rod including an internal channel to convey make-up water to the tank from an external water source, the piston rod including means for connecting the internal channel with an external water source.

6. A mineral jig apparatus comprising:

a supporting framework;

at least one jig tank which retains water and material being concentrated, the jig tank having a lower portion and an upper portion, the upper portion having a screen atop which ore to be processed is fed to the jig, the lower portion having a drain for discharging concentrated ore from the tank, the jig tank being substantially separated into at least two compartments;

a piston and cylinder assembly mounted within the tank, the piston and cylinder assembly defining an interface between the two compartments to reciprocatingly pulsate water within the two respective compartments upon reciprocating motion of a piston within a cylinder;

drive means for imparting reciprocating action to the piston;

wherein the piston and cylinder assembly comprises a cylinder, a piston assembly and a piston rod connected to the piston assembly;

the piston rod including an internal channel to convey make-up water to the tank from an external water source, the piston rod including means for connecting the internal channel with an external water source;

the piston assembly comprising a pair of separated piston plates oriented transversely relative to the cylinder, the separated piston plates defining a space therebetween, the space defining a separation distance between the piston plates, the piston rod being connected to at least one of the piston plates, the internal piston rod channel communicating with the space between the piston plates to expel make-up water thereto; and the cylinder having a length which is approximately equal the separation distance between the piston plates, one of the piston plates being moved into the cylinder upon a piston stroke, the other of the piston plates being moved away from the cylinder upon the piston stroke.

7. A mineral jig apparatus of claim g, wherein the piston and cylinder assembly is mounted within the tank such that the reciprocating motion of the piston is in a lateral direction.

8. The mineral jig apparatus of claim 6 wherein the piston rod is supported for reciprocating motion by at least two leaf springs.

9. A mineral jig apparatus comprising:

a supporting framework;

at least one jig tank which retains water and material being concentrated, the jig tank having a lower portion and an upper portion, the upper portion having a screen atop which ore to be processed is fed to the jig, the lower portion having a drain for discharging concentrated ore from the tank, the jig tank being substantially separated into at least two compartments;

a piston and cylinder assembly mounted within the tank, the piston and cylinder assembly defining an interface between the two compartments to reciprocatingly pulsate water within the two respective compartments upon reciprocating motion of a piston within a cylinder;

drive means for imparting reciprocating action to the piston;

the piston and cylinder assembly being mounted within the tank such that the reciprocating motion of the piston is in a lateral direction; and the piston rod being supported for reciprocating motion by at least two downwardly hanging leaf springs.

10. A mineral jig apparatus comprising:

a supporting framework;

at least one jig tank which retains water and material being concentrated, the jig tank having a lower portion and an upper portion, the upper portion having a screen atop which ore to be processed is fed to the jig, the lower portion having a drain for discharging concentrated ore from the tank, the jig tank being substantially separated into at least two compartments;

a piston and cylinder assembly mounted within the tank, the piston and cylinder assembly defining an interface between the two compartments to reciprocatingly pulsate water within the two respective compartments upon reciprocating motion of a piston within a cylinder;

drive means for imparting reciprocating action to the piston;

the piston and cylinder assembly comprising a cylinder, a piston assembly and a piston rod connected to the piston assembly;

the piston assembly comprising a piston mounted for movement along a line of piston stroke, the piston having a length along the line of piston stroke;

the cylinder having sidewalls which have a length along the line of piston stroke which is greater than the piston length; and at least one make-up water inlet provided through the cylinder sidewalls.

11. The mineral jig apparatus of claim 10 wherein the make-up water inlet has a length along the line of piston stroke, the make-up water inlet length being greater than the piston length.

12. The mineral jig apparatus of claim 10 wherein the two compartments are laterally oriented relative to one another, and the piston and cylinder assembly is mounted within the tank such that the reciprocating motion of the piston is in a lateral direction.

13. The mineral jig apparatus of claim 10 wherein the piston rod is supported for reciprocating motion by at least two leaf springs.

14. A mineral jig apparatus comprising:

a supporting framework;

at least one jig tank which retains water and material being concentrated, the jig tank having a lower portion and an upper portion, the upper portion having a screen atop which ore to be processed is fed to the jig, the lower portion having a drain for discharging concentrated ore from the tank, the jig tank being substantially separated into at least two compartments;

a piston and cylinder assembly mounted within the tank, the piston and cylinder assembly defining an interface between the two compartments to reciprocatingly pulsate water within the two respective compartments upon reciprocating motion of a piston within a cylinder;

drive means for imparting reciprocating action to the piston;

the cylinder comprising a plenum which defines cylinder walls to slidably retain the piston within the cylinder, the cylinder walls comprising screen material, the plenum having at least one water inlet for injecting water to within the plenum.

15. A mineral jig apparatus comprising:

a supporting framework;

at least one jig tank which retains water and material being concentrated, the jig tank having a lower portion and an upper portion, the upper portion having a screen atop which ore to be processed is fed to the jig, the lower portion having a drain for discharging concentrated ore from the tank, the jig tank being substantially separated into at least two compartments which are laterally oriented relative to one another;

an agitator mounted within the tank to impart pulsations to water within the two respective compartments, the agitator including a driving rod, the driving rod being supported for reciprocating motion by at least two leaf springs; and drive means for imparting reciprocating motion to the driving rod.

16. The mineral jig apparatus of claim 15 further comprising separate make-up water inlets provided for each of the two compartments.

17. The mineral jig apparatus of claim 15 wherein the agitator comprises a plate mounted to the driving rod, the plate being mounted to a flexible diaphragm.

18. The mineral jig apparatus of claim 15 wherein the drain comprises only a single drain which communicates with each of the two compartments, the two compartments being in direct fluid communication with one another immediately adjacent the single drain to facilitate draining of concentrated ore from each compartment and unclogging action relative to the single drain by reciprocating water pulsations between the two compartments immediately adjacent the single drain.

19. A mineral jig apparatus comprising:

a supporting framework;

at least one jig tank which retains water and material being concentrated, the jig tank having a lower portion and an upper portion, the upper portion having a screen atop which ore to be processed is fed to the jig, the lower portion having a drain for discharging concentrated ore from the tank, the jig tank being substantially separated into at least two compartments oriented laterally relative to one another;

a piston and cylinder assembly mounted within the tank, the piston and cylinder assembly defining an interface between the two compartments to reciprocatingly pulsate water within the two respective compartments upon reciprocating motion of a piston within a cylinder, the piston and cylinder assembly comprising:

a cylinder, a piston assembly and a piston rod connected to the piston assembly; the cylinder, piston assembly and piston rod being oriented such that the reciprocating motion of the piston assembly is in a lateral direction;

the piston rod including an internal channel to convey make-up water to the tank from an external water source, the piston rod including means for connecting the internal channel with an external water source, the piston rod being supported for lateral reciprocating motion by at least two downwardly hanging leaf springs;

the piston assembly comprising a pair of separated piston plates oriented transversely relative to the cylinder, the separated piston plates defining a space therebetween, the space defining a separation distance between the piston plates, the piston rod being connected to at least one of the piston plates, the internal piston rod channel communicating with the space between the piston plates to expel make-up water thereto; and the cylinder having a length which is approximately equal the separation distance between the piston plates, one of the piston plates being moved into the cylinder upon a piston stroke, the other of the piston plates being moved away from the cylinder upon the piston stroke; and the mineral jig apparatus further comprising: drive means for imparting reciprocating action to the piston.

20. The mineral jig apparatus of claim 19 wherein the drain comprises only a single drain which communicates with each of the two compartments, the two compartments being in direct fluid communication with one another immediately adjacent the single drain to facilitate draining of concentrated ore from each compartment and unclogging action relative to the single drain by reciprocating water pulsations between the two compartments immediately adjacent the single drain.

* * * * *